US006726304B2

(12) United States Patent
Fassler et al.

(10) Patent No.: US 6,726,304 B2
(45) Date of Patent: Apr. 27, 2004

(54) CLEANING AND REPAIRING FLUID FOR PRINTHEAD CLEANING

(75) Inventors: Werner Fassler, Rochester, NY (US); Charles D. DeBoer, Palmyra, NY (US); John E. Mooney, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 28 days.

(21) Appl. No.: 09/169,071

(22) Filed: Oct. 9, 1998

(65) Prior Publication Data

US 2002/0012022 A1 Jan. 31, 2002

(51) Int. Cl.[7] ..... B41J 2/165; B41J 2/135

(52) U.S. Cl. ..... 347/28; 347/33; 347/45

(58) Field of Search ..... 347/28, 33, 47, 347/46, 45, 100; 106/31.27, 31.6

(56) References Cited

U.S. PATENT DOCUMENTS

| | | | | |
|---|---|---|---|---|
| 4,306,245 A | | 12/1981 | Kasugayama et al. | |
| 4,389,654 A | * | 6/1983 | Bar-On et al. | 347/75 |
| 4,673,303 A | * | 6/1987 | Sansone et al. | 400/126 |
| 4,679,059 A | | 7/1987 | Dagna | |
| 4,746,938 A | | 5/1988 | Yamamori et al. | |
| 4,853,717 A | | 8/1989 | Harmon et al. | |
| 4,855,764 A | | 8/1989 | Humbs et al. | |
| 5,128,690 A | | 7/1992 | Nozawa | |
| 5,250,962 A | | 10/1993 | Fisher et al. | |
| 5,291,226 A | * | 3/1994 | Schantz et al. | 347/63 |
| 5,305,015 A | | 4/1994 | Schantz et al. | |
| 5,311,218 A | * | 5/1994 | Ochiai et al. | 347/71 |
| 5,350,616 A | | 9/1994 | Pan et al. | |
| 5,397,386 A | * | 3/1995 | Nakazawa et al. | 106/22 K |
| 5,426,458 A | | 6/1995 | Wenzel et al. | |
| 5,431,722 A | | 7/1995 | Yamashita et al. | |
| 5,559,540 A | * | 9/1996 | Burolla | 347/45 |
| 5,598,193 A | * | 1/1997 | Halko et al. | 347/45 |
| 5,666,143 A | * | 9/1997 | Burke et al. | 347/65 |
| 5,706,039 A | * | 1/1998 | Chamberlain et al. | 347/28 |
| 5,725,647 A | | 3/1998 | Carlson et al. | |
| 5,738,716 A | | 4/1998 | Santilli et al. | |
| 5,825,380 A | * | 10/1998 | Ichizawa et al. | 347/28 |
| 5,845,380 A | * | 12/1998 | Thiel | 347/40 |
| 5,994,427 A | * | 11/1999 | Kappele et al. | 523/160 |
| 6,109,728 A | * | 8/2000 | Kakuda et al. | 347/45 |

FOREIGN PATENT DOCUMENTS

| | | | | |
|---|---|---|---|---|
| DE | 003236763 A1 | * | 4/1984 | 347/33 |
| EP | 0263689 | | 10/1987 | |
| EP | 0621136 | | 4/1994 | |
| GB | 2203994 | | 12/1991 | |

OTHER PUBLICATIONS

Hawley's Condensed Chemical Dictionary, Richard J. Lewis, Sr., 13th Ed., 1997, p. 583.*

* cited by examiner

*Primary Examiner*—Michael S. Brooke
(74) *Attorney, Agent, or Firm*—Raymond L. Owens

(57) ABSTRACT

An ink jet printing apparatus having a cleaning station that cleans the orifice plate with a cleaning liquid. The cleaning liquid includes a hydrophobic additive that has a strong affinity for the orifice plate material and which coats the orifice plate to form a protective coating. If a portion of the protective coating is removed, that portion will be repaired by the additive.

2 Claims, 3 Drawing Sheets

CLEANING AND REPAIRING FLUID FOR PRINTHEAD CLEANING

FIELD OF THE INVENTION

This invention relates to inkjet printing and, more particularly, to a cleaning fluid for cleaning an inkjet printing head with a hydrodynamic cleaning apparatus and applying a protective layer to the surface of the printhead.

BACKGROUND OF THE INVENTION

Inkjet printing is a non-impact method for producing images by the deposition of ink droplets on a substrate (paper, transparent film, fabric, etc.) in response to digital signals. Inkjet printers have found broad applications across markets ranging from industrial labeling to short run printing to desktop document and pictorial imaging. In recent years the drop size of inkjet printers has tended to become smaller and smaller, resulting in higher resolution and higher quality prints. The smaller drop size is accompanied by smaller nozzle openings in the inkjet printhead. These smaller nozzle openings are easier to plug and more sensitive to extraneous deposits which can affect both the size and placement accuracy of the inkjet drop.

It has been recognized that there is a need to maintain the ink ejecting nozzles of an inkjet printhead, for example, by periodically cleaning the orifices when the printhead is in use, and/or by capping the printhead when the printer is out of use or is idle for extended periods of time. The capping of the printhead is intended to prevent the ink in the printhead from drying out. There is also a need to prime a printhead before use, to insure that the printhead channels are completely filled with ink and contain no contaminants or air bubbles and also periodically to maintain proper functioning of the orifices. Maintenance and/or priming stations for the printheads of various types of inkjet printers are described in, for example, U.S. Pat. Nos. 4,855,764; 4,853,717; and 4,746,938. Removal of gas from the ink reservoir of a printhead during printing is described in U.S. Pat. No. 4,679,059. In U.S. Pat. No. 4,306,245 to Kasugayama et al., a liquid jet recording device provided with a cleaning protective means for cleaning and protecting an orifice is described. The cleaning protective means is provided at a reset position lying at one end of the scanning shaft of the device.

U.S. Pat. No. 5,128,690 to Nozawa, describes an inkjet apparatus comprising an inkjet head having plural discharge openings for discharging ink. A partial cap member, which can cover at least one of the discharge openings, is connected to a pressure source that can supply sufficient pressure through the covered discharge openings to force any foreign matter into a common liquid chamber. A liquid flow is created in the common chamber to flush the foreign matter from the inkjet head.

U.S. Pat. No. 5,250,962 to Fisher et al., describes a movable priming station for use with an inkjet printer having a printhead with a linear extended array of nozzles. The movable priming station includes a support capable of moving along the extended array of nozzles and a vacuum tube having a vacuum port adjacent to one end thereof. The support is controlled so that the vacuum port does not contact the nozzle containing surface of the printhead when the support is moved along the linear array of nozzles.

U.K. Patent Application GB2203994 to Takahashi et al., describes an applicator for applying antiwetting compositions to the nozzle bearing face of a printhead of an ink drop printer. The printhead which reciprocates across the face of a platen is moved to one end of the platen where the applicator is placed. The applicator includes an extendable pad which wipes the face of the printhead.

European Patent Application 0263689 to Funk, et al., describes a fluid applicator head in which fluid is to be ejected though a plurality of nozzle orifices by means of pressure pulses or by valve means which control the flow of fluid. The applicator head is flushed out by passing a flushing fluid through the nozzle orifices in which the applicator head is adapted to be moved from a position of applying droplets of fluid to a substrate and to a flushing position at which the nozzle orifices engage with a flushing member so that flushing fluid can flow through the nozzle orifices or conduits associated therewith.

European Patent Application 0621136 to Claflin et al., describes a wet wipe maintenance device for a full width inkjet printer. A shuttle is adapted to travel on a track through a fixed path parallel to an array of nozzle openings defined in a surface of a printhead. Mounted on the shuttle are an applicator for applying a liquid to the nozzle openings and a vacuum device for applying suction to the nozzle openings. The applicator is a wick of urethane felt through which water is supplied.

U.S. Pat. No. 4,306,245 to Kasugayama et al describes a device for cleaning discharge orifices of an inkjet recording head. When the recording head moves to a print scanning region, the recording medium liquid adhering around the discharge orifices is rubbed off by a liquid absorber fitted in a rubbing-off port adjacent to a recovery port.

U.S. Pat. No. 4,306,245 to Kasugayama et al describes an inkjet recorder including a capping mode in which a cap body is brought into contact with a nozzle of a recording head so as to hermetically seal the nozzle. In a recovery mode, the cap body and a vacuum pump communicate with each other to return the recording head to a normally operative condition.

Conventional continuous inkjet printing utilizes electrostatic charging "tunnels" that are placed close to the point where the ink drops are formed in a stream. In this manner, individual drops may be charged, and these drops may be deflected downstream by the presence of deflector plates that have a large potential difference between them. A gutter (sometimes known as a "catcher") may be used to intercept the charged drops, while the uncharged drops are free to strike the recording medium. If there is no electric field present, or if the drop break off point is sufficiently far from the electric field (even if a portion of the stream before the drop break off point is in the presence of an electric field), then charging will not occur.

Inks for high-speed inkjet drop printers must have a number of special characteristics. Typically, water-based inks have been used because of their conductivity and viscosity range. Thus, for use in a jet drop printer the ink must be electrically conductive, having a resistivity below about 5000 ohm-cm and preferably below about 500 ohm-cm. For good fluidity through small orifices, the water-based inks generally have a viscosity in the range between 1 and 15 centiposes at 25° C.

Beyond this, the inks must be stable over a long period of time, compatible with inkjet materials, free of microorganisms and functional after printing. Required functional characteristics include resistance to smearing after printing, fast drying on paper, and being waterproof when dried.

Problems to be solved with aqueous inkjet inks include the large energy needed for drying, cockling of large printed areas on paper surfaces, ink sensitivity to rubbing, the need for an anti-microbial agent and clogging of the inkjet printer orifices from dried ink an other adventitious contaminants.

The non-water component of inkjet inks generally serves as a humectant which has a boiling point higher than that of water (100(C). The ink liquid vehicle components, i.e., the water and the humectants, generally possess absorption characteristics on paper and evaporation properties allowing for the desired inkjet printing speed when the ink is to be used in an inkjet printing process.

Many inkjet ink formulation have been patented. U.S. Pat. No. 5,738,716 by Domenic Santilli, et al. issued Apr. 14, 1998 describes the preparation of inkjet inks by dispersing pigments in water.

U.S. Pat. No. 5,431,722 by Yoshiro Yamashita, et al. issued Jul. 11, 1995 discloses the use of a buffer to control the pH of inkjet ink.

U.S. Pat. No. 5,350,616 by Alfred I Pan., et al., issued Sep. 27, 1994 describe nozzle orifices with combined non-wettable and wettable surfaces.

U.S. Pat. No. 5,305,015 Christopher A. Schantz, et al., issued Apr. 19, 1994 ablate nozzle openings from a polyamide film with a laser.

U.S. Pat. No. 5,426,458 Donald E Wenzel., et al., issued Jun. 20, 1995 use poly-p-xylylene films as nozzle orifice surface coatings.

U.S. Pat. No. 5,725,647 James G Carlson., et al., issued Mar. 10, 1998 disclose pigmented inks with added humectants.

An effective cleaning solution for an inkjet printing head will have to be compatible with the ink used, and the many limitations on the ink described above.

There remains a need for a simple, economical inkjet printhead cleaning solution that will consistently deliver an accurate and reproducible drop of ink to provide uniform, accurate and consistent prints.

SUMMARY OF THE INVENTION

An object of this invention is to provide an inkjet cleaning fluid that is simple and effective in cleaning and protecting inkjet nozzles.

This object is achieved by a cleaning fluid for use with an inkjet printer having orifices for ejecting ink, the surface of the orifices at the ejection point being formed by a predetermined material, comprising:

a) a liquid for cleaning the orifice surface; and b) an additive in the liquid having a strong affinity for the material which forms the orifice surface and coats such surface to form a protective coating of such additive so that if a portion of the protective coating is removed, such portion will be repaired by the additive material.

ADVANTAGES

An advantage of this invention is that the ink used with the cleaning fluid can be simplified and employ a wider range of colorants.

Another advantage is that the cleaning fluid provides and replenishes a protective layer on the surface of the inkjet printhead to improve the uniformity of the inkjet droplet size and accuracy of droplet placement.

DETAILED DESCRIPTION OF THE INVENTION

Figure 1:
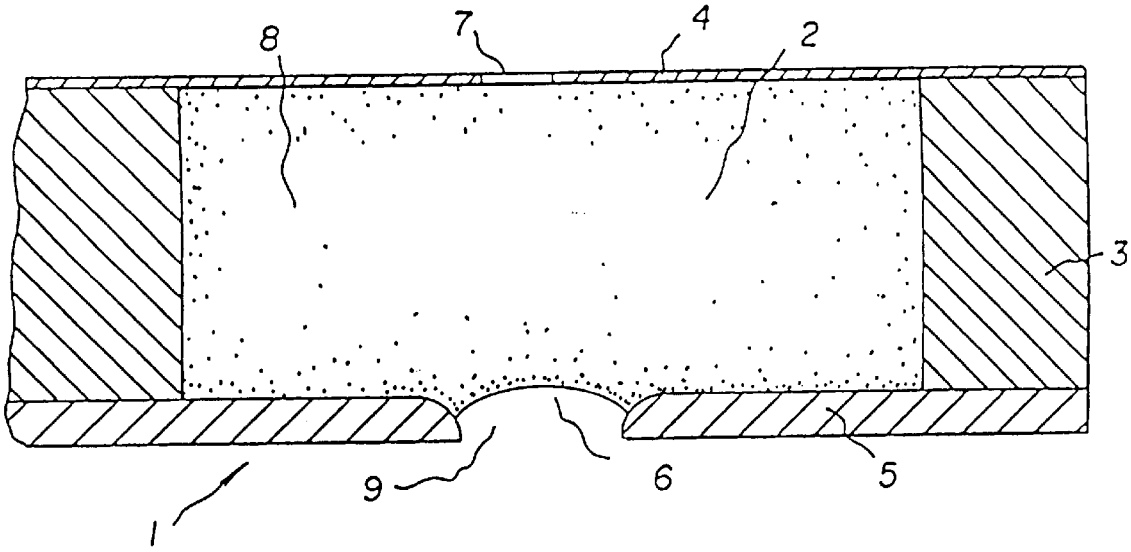
FIG. 1 is a prior art cross sectional schematic view of a typical piezo electric inkjet printhead.

FIG. 1 shows a cross-sectional view of an inkjet printhead 1. Orifice defining structures such as the depicted outlet plate 5 include orifice 9 that can be manufactured by electroforming or sheet metal fabrication methods. An ink meniscus 6 is shown in the orifice 9. It will be understood that the outlet plate 5 actually includes a plurality of orifices for forming multiple ink droplets. The outlet plate 5 is glued to the piezo walls 3. Ink 2 is included in a pumping cavity 8. The ink can include an additive having a strong affinity for the material that forms the pumping cavity surface and that coats such surfaces to form a protective coating of such additive so that if a portion of the protective coating is removed, such portion will be repaired by the additive material. The additive that coats and protects the surface can itself have a surface energy and character with a wide range of properties. For example, the surface protecting agent for a gold or silver surfaced pumping cavity 8 can be an alkane thiol to provide a hydrophobic surface, a mercaptopropyltrihydroxysilane for a neutral hydrophilic surface, a thioalkylsurfonic acid for an anionic hydrophilic surface, or a thioalkyltrimethylammonium salt for a cationic hydrophilic surface. A surface of intermediate hydrophobic character is achieved by an ink additive of 1-phenyl-2-tetrazoline-5-thione. Other common thiols that can be employed as the ink additive 105 are 2-mercaptoimidazole, 2-mercapto-5-methylbenzimidazole, 2-mercapto-1-methylimidazole, Captopril, 2-mercapto-4-methylpyrimidine, 2-mercapto-5-methyl-1,3,4-thiadiazole, 2-mercaptonicotinic acid, 3-mercapto-1-propanol, N-2 (mercaptopropionyl)glycine, and 4-mercaptopyridine. In a preferred embodiment of the invention, the surface provided by the ink additive is hydrophilic, to provide effective wetting of the pumping cavity 8 surface and thereby reduce the formation of air bubbles that can be compressed when the pumping cavity is energized to squeeze the chamber to eject ink through the orifice 9, such compression absorbing part of the pumping energy and thereby reducing the droplet size. Ink additives to protect inkjet printhead surfaces are more completely described in U.S. patent application Ser. No. 09/169,336 filed Oct. 9, 1998 (78367) to Fassler et al entitled "Ink Additive for Jet Orifice Protection," now abandoned. An inlet orifice 7 formed in an inlet plate 4 permits ink to be delivered to the pumping cavity 8.

Figure 2:
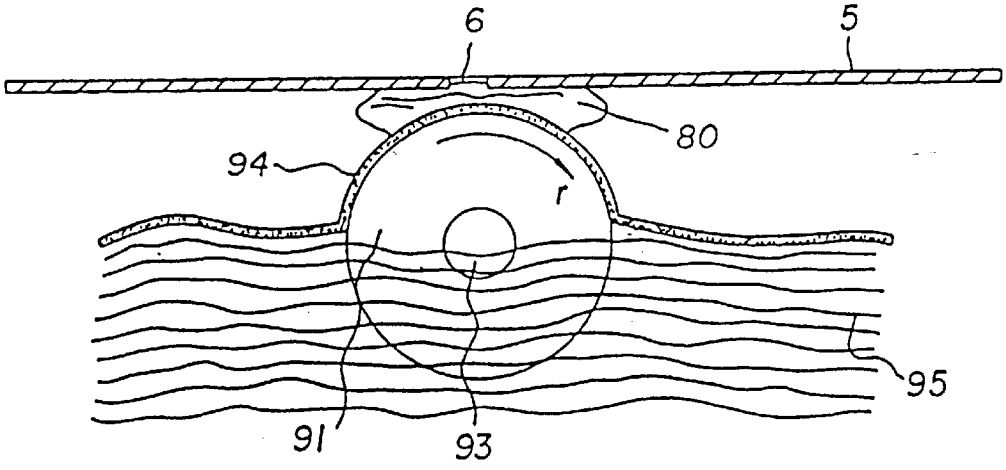
FIG. 2 shows a cleaning station with a roller for applying a cleaning liquid to clean the orifices.

FIG. 2 shows a cleaning station with a roller for applying a cleaning liquid to clean the orifices. The cleaning station includes, mounted to a shaft 93, a rotating cleaning roller 91 that is partially submerged in the cleaning fluid and spaced from the structure defining the orifices 9 to form a cavity space 80. The cleaning fluid includes a liquid and at least one additive with a strong affinity for the orifice surface 9 and the outlet plate 5. The cleaning roller 91, as it rotates, carries by surface tension a surface coating 94 of cleaning fluid 95 to the outlet orifice plate 5. The roller or the roller surface is made from a material that can be wetted by the cleaning fluid. Such roller surface material can be selected from the group consisting of aluminum, teflon, polyvinyl chlorine, stainless steel, glass, and titanium, or any material that can be easily machined or molded. The liquid fills the cavity space 80. The liquid surface friction between the stationary outlet orifice plate 5 and the rotating cleaning roller 91 will cause a great amount of turbulence and liquid shearing to remove dirt and ink from the outlet orifice plate 5 in and near the orifices 9. An arrow marked "r" indicates one of the possible two rotational direction of the cleaning roller 91.

Figure 3:
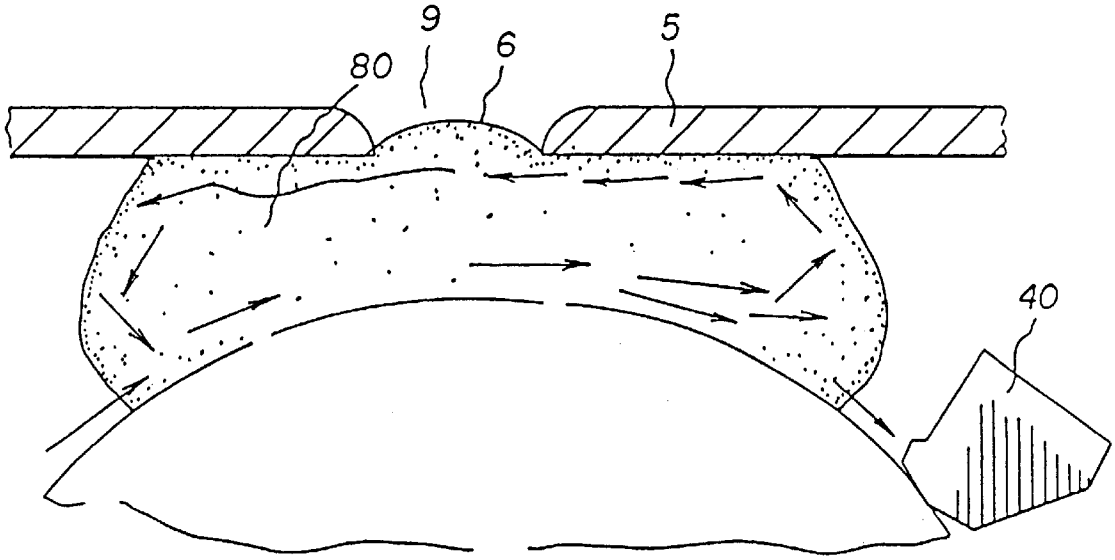
FIG. 3 shows an enlargement of the cleaning liquid coating depicting its turbulent flow in the direction opposite the rotation direction of the cleaning roller.

FIG. 3 shows in an enlarged form how the fluid friction shown by arrows causes the flow of the cleaning fluid to shear dirt and other particles 40 permanently from the outlet orifice plate 5. The arrows indicate the flow of fluid in the cleaning cavity space 80 caused by surface friction of orifice plate 5 and cleaning roller 91.

Figure 4:
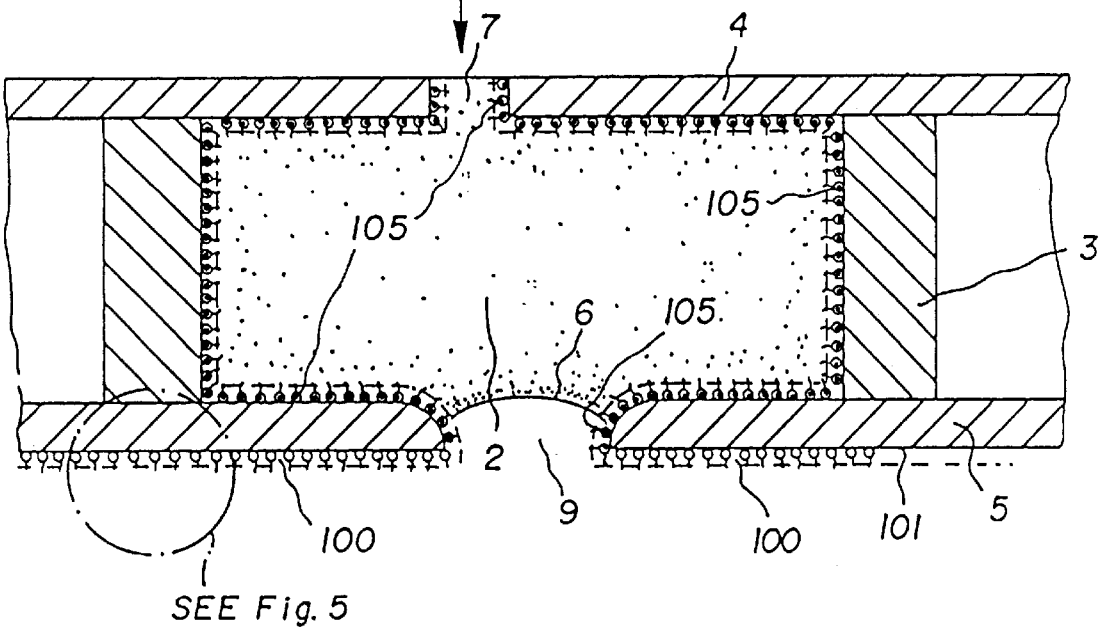
FIG. 4 shows the printhead of FIG. 1 with the surface of the orifice plate protected by a coating of alkane thiol provided by the cleaning fluid.

FIG. 4 shows the inkjet printer of FIG. 1 with the silver or gold surfaces 101 of the orifice plate 5 coated with the cleaning fluid additive 100. It will be understood by those skilled in the art that the scale of the drawing in FIG. 4 is not accurate, and that the molecules of cleaning fluid additive 100 are much enlarged from their true size for illustrative purposes. The inside surface of the pumping cavity is shown coated with a surface of molecules of the ink additive 105.

Figure 5:
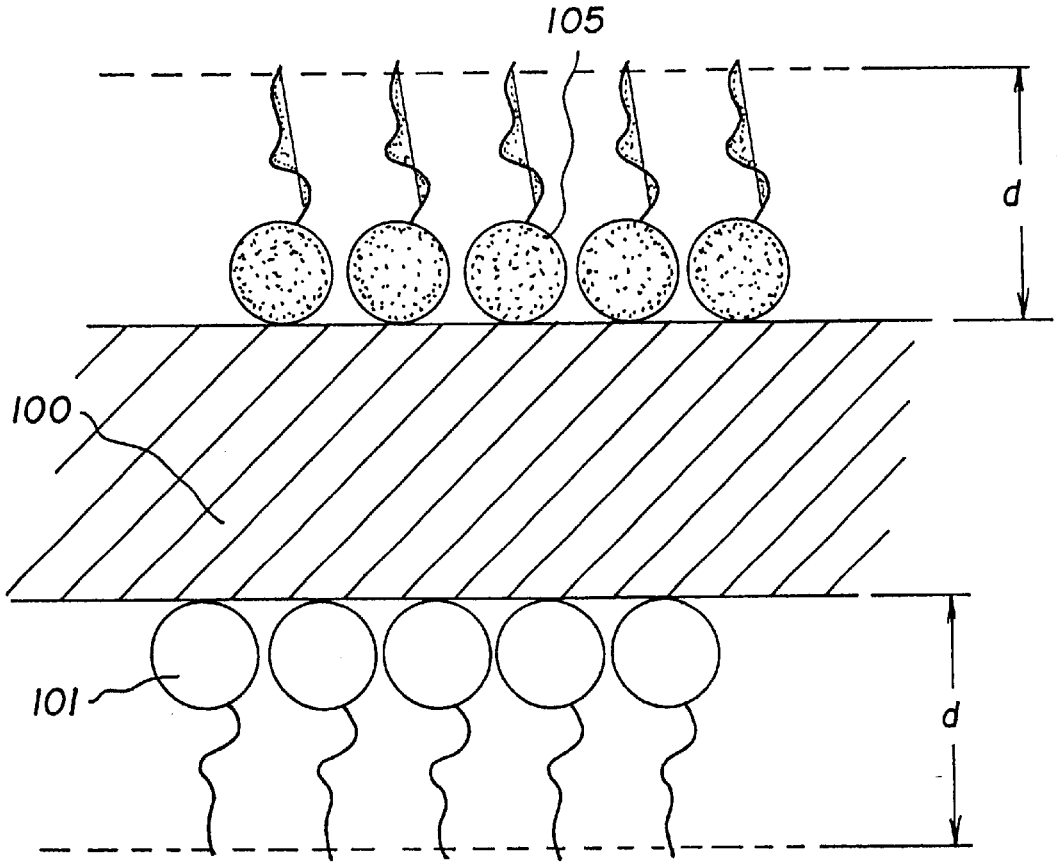
FIG. 5 shows a close-up view of the magnified portion of FIG. 4 showing the surface of the orifice plate of FIG. 4 with an alkane thiol protected surface.

FIG. 5 shows a magnified portion of FIG. 4, showing the silver or gold surface 101 with the molecules of the cleaning fluid additive 100 coating the surface and the molecules of ink additive 105 coating the opposite surface. In this figure the portion of the additive which has a strong affinity for the material which forms the surface of the orifice plate 5 is indicated by the circles on the surface and the remaining part of the cleaning fluid additive 100 is indicated by the black "tail" of the molecule. In a preferred embodiment of the invention, the orifice plate 5 is constructed with a surface of metallic gold or silver, which can be achieved by chemical plating or by vacuum evaporation of the metal, both methods being well known to those skilled in the art. In this preferred embodiment of the invention with a gold or silver surfaced orifice plate 5, the protective material cleaning fluid additive 100 is a thiol compound, such as dodecane thiol, which has a high affinity for silver, and readily forms a close packed array on the surface of the silver, with the thiol groups at the silver surface and the hydrocarbon dodecane groups extending away from the silver surface, in appearance much like a dense forest of hydrocarbon trees on a silver field. This hydrocarbon surface is only about 20 Angstroms thick, and is thus easily removed by a stray scratching particle in the ink, but is easily and rapidly replenished by the process of self-assembly from dodecane thiol, because of the high chemical affinity between silver and thiol groups. The hydrocarbon surface has a low surface energy, and does not absorb high energy colorants from the ink, thus preventing orifice plugging.

In a preferred embodiment of the invention, the dodecane thiol cleaning fluid additive described above provides a hydrophobic hydrocarbon surface on the orifice. A hydrophobic surface which will not be wetted by water based inkjet ink may be desirable to prevent ink from leaking from one outlet orifice to another. It may also be desirable to have a hydrophobic surface on the orifice plate 5 and a hydrophilic surface inside the pumping cavity 8. In that case, a hydrophobic additive can be used in the cleaning fluid, and a hydrophilic additive in the ink, as described above. Alternatively, the pumping cavity can be made of a material that has a hydrophilic surface that has no attraction for the additive in the cleaning fluid.

The amount of additive needed to protect the surface of the inkjet chamber and orifice is small, since a monolayer coating of additive occupies a low volume fraction of the total volume of ink in the chamber. In practice it is found that 1 part of additive per 10,000 parts of cleaning fluid or ink are sufficient to provide a large excess of the amount of additive needed to provide a complete covering of the surface of the chamber, as shown below in the experimental examples.

As described in the section on the background of the invention, among the causes of inkjet clogging are growth of bacterial colonies, drying of ink particles, and failure to wet the nozzle surfaces. For these reasons, biocides, humectants, and surfactants or detergents are included in the inkjet inks. Not all biocides, humectants and surfactants are compatible with the colorants used in inkjet printing. In particular, when dispersed pigments are used as colorants, an incompatible ingredient can cause clumping and agglomeration of the pigment, resulting in either or both a) plugging of the inkjet head, and b) loss of covering power and image density of the colorant. This can limit the choice of colorants for inkjet inks, resulting in more costly inks and colorants of less than optimum hue.

In this invention, the functions of biocide, humectant and surfactant are all performed by one compound, a di or trihydroxysilane, and those functions can be done in the cleaning fluid, rather than the ink. In a preferred embodiment of the invention, the cleaning fluid includes from about 5% to about 50% 3-aminopropyltrihydroxysilane in water. Other silanes which form stable solutions in water can be used, such as 3-(2-aminoethyl) aminopropyltrihydroxysilane, N-trimethoxysilylpropyl-N, N,N-trimethylammoniumchloride, trihydroxysilylpropanesulfonic acid and salts thereof, and reaction products of 3-aminopropyl-trihydroxysilane and various epoxides, such as glycidol, as well as reaction products of 3-glycidoxypropyltrihydroxysilane and various amines, such as benzylamine.

Along with the principle liquid, usually water, in the cleaning fluid, co-solvents such as N-methylpyrollidinone and butyrolactone, humectants such as ethylene glycol and sorbitol, biocides such as triclosan (Ciba Specialty Chemicals, Basel, Switzerland), viscosity builders such as polyethyleneglycol, surfactants such as Zonyl FSN (duPont Corp, Wilmington, Del.), wetting agents, leveling agents and the like can be added to provide desirable characteristics to the cleaning fluid.

The following example will help to illustrate this invention.

EXAMPLE 1

A rough gold surface was provided by vacuum sputtering gold on a grained anodized aluminum lithographic printing plate surface at 100 millitorr argon pressure with a current of 40 milliamps for 3 minutes, or until the gold was opaque. This rough surface is representative of the surface of a piezo inkjet pressure chamber. Half of the gold surface was dipped into a 0.01% solution of dodecane thiol in a 50:50 mixture of isopropylalcohol and water, rinsed off in water and dried under a stream of dry nitrogen. Magenta inkjet ink was dripped onto both the treated half and the un-treated half of the gold surface and allowed to dry at 80 degrees C. in a convention oven. The ink used was a mixture of 50% diethyleneglycol, 22% diethyleneglycol monobutylether, 1% urea, 0.15% surfynol440 (a surfactant from Air Products Co.) and 10% 4-(2-hydroxy-1-naphthylazo)-1-naphthalenesulfonic acid, sodium salt, with the remainder of the mixture being water. The stained gold surface was then washed with water with the hydrodynamic cleaner device of the invention. When dried with a stream of air, most of the ink was observed to have been removed, but there was a visible stain of magenta ink remaining, and the stain was heavier on the gold surface that had not been pre-treated with the cleaning solution of this invention. The gold surface was then cleaned with a 10% solution of 3-aminopropyltriethoxysilane in water, and the stain was gone. This example shows that the cleaning solution of this invention protects and repels ink stains on a gold surface.

The invention has been described in detail, with particular reference to certain preferred embodiments thereof, but it should be understood that variations and modifications can be effected with the spirit and scope of the invention.

PARTS LIST

1 inkjet printhead
2 ink
3 piezo walls
4 inlet orifice plate
5 outlet orifice plate
6 ink meniscus
7 inlet orifice
8 pumping activity
9 orifice
40 particles
80 cavity space
91 cleaning roller
93 shaft
94 surface coating
95 cleaning fluid
100 cleaning fluid additive
101 silver or gold surface
105 ink additive

What is claimed is:

1. An inkjet printhead including a cleaning structure defining:

a) an outlet orifice plate having a plurality of orifices for ejecting ink droplets and having a surface formed of material including silver or gold;

b) means defining a pumping cavity in communication with the orifices for receiving ink and formed, at least in part, of a piezo electric material which, when energized, squeezes the pumping cavity to eject ink through the orifice; and c) a cleaning station including means for applying a cleaning liquid to clean the orifice plate, such cleaning liquid including a hydrophobic additive in the liquid having a strong affinity for the material which forms the orifice surface and coats such surface to form a protective coating of such additive so that if a portion of the protective coating is removed, such portion will be repaired by the additive material.

2. An inkjet printhead including a cleaning structure defining:

a) an outlet orifice plate having a plurality of orifices for ejecting ink droplets and having a surface formed of material including silver or gold;

b) means defining a pumping cavity in communication with the orifices for receiving ink and formed, at least in part, of a piezo electric material covered with a layer including silver or gold which, when energized, squeezes the pumping cavity to eject ink through the orifice, the ink including a hydrophilic additive which effectively wets the pumping cavity layer to reduce the formation of air bubbles; and c) a cleaning station including means for applying a cleaning liquid to clean the orifice plate, such cleaning liquid including a hydrophobic additive in the liquid having a strong affinity for the material which forms the orifice surface and coats such surface to form a protective coating of such additive so that if a portion of the protective coating is removed, such portion will be repaired by the additive material.

* * * * *